United States Patent [19]

Wymore

[11] 4,345,873

[45] Aug. 24, 1982

[54] MATERIAL HANDLING VEHICLE

[76] Inventor: Roger S. Wymore, 4612 F. Ave., NE., Cedar Rapids, Iowa 52402

[21] Appl. No.: 155,210

[22] Filed: Jun. 2, 1980

[51] Int. Cl.[3] ..... B66F 9/06

[52] U.S. Cl. ..... 414/714; 212/189

[58] Field of Search ..... 414/714, 719, 710, 713, 414/622, 917; 280/762, 764; 212/189; 187/9 E

[56] References Cited

U.S. PATENT DOCUMENTS

| | | | |
|---|---|---|---|
| 3,067,887 | 12/1962 | Quayle | 414/710 |
| 4,054,185 | 10/1977 | Stedman | 414/917 |
| 4,226,331 | 10/1980 | Dumond | 212/189 |

*Primary Examiner*—James B. Marbert

*Attorney, Agent, or Firm*—James C. Nemmers; Haven E. Simmons

[57] ABSTRACT

A vehicle for handling heavy loads and moving them short distances. The vehicle has a lifting linkage arrangement that allows the center of gravity of the load to be carried over the front wheels or between the front and rear wheels after the initial lifting phase. Initial lifting is aided by an outrigger and loadrest. This design therefore eliminates the need for a heavy vehicle using counterweights and provides a vehicle that has maximum maneuverability and lifting capacity.

7 Claims, 6 Drawing Figures

MATERIAL HANDLING VEHICLE

BACKGROUND OF THE INVENTION

There are known and commercially available a number of different designs of vehicles for handling and moving loads, especially loads on pallets, short distances. Vehicles commonly referred to as "forklifts" have been used for many years in numerous industrial and other applications. The forklift has a fork-vertical slide mechanism for engaging and lifting the load, and the moment of the load is offset by the counter-moment of the vehicle. The axle of the front wheels of the forklift provides the fulcrum in both the stationary-load position and the dynamic-carry mode. By tilting the mast containing the fork-slide mechanism, the moment of the load is reduced somewhat, but a substantial counterweight is still required, and the forklift cannot carry a load in excess of its own weight.

There is also known and commercially available a material handling vehicle which can lift and carry loads in excess of its own weight. This vehicle has a variable wheel base provided by a design that permits the front wheels, which are mounted on "legs", to be extended as the load is lifted and carried. The rear wheels or wheels can also be extended or withdrawn. In this manner, the lifting moment is eliminated since the load will be between the front and rear supporting wheels. Thus, there is no necessity for a counterweight. However, with this vehicle, the load must be lifted and carried between the front wheels thus limiting the use of the vehicle to those situations where space permits the vehicle to travel with a wide stance. Also, because of the mechanism required for extending and withdrawing the wheels, the vehicle is relatively expensive.

There is therefore a need for a material handling vehicle that is capable of lifting loads in excess of its weight and which is small enough in physical size to be useful in applications where space is limited. There is also a need for a relatively inexpensive material handling vehicle that can carry loads comparable to the standard forklift in industrial applications where space is limited and also in other applications as well.

SUMMARY OF THE INVENTION

The material handling vehicle of the invention is a fixed wheel base stable vehicle supported on either three or four wheels. Most of the machine weight is over the rear axle which also serves as the steering axle. Unlike the prior art machines, the lift mechanism does not utilize a fork-slide mechanism, but rather the lifting fork is secured to a linkage mechanism that is basically a double four-bar linkage arrangement. With this linkage, the load can be lifted and swung rearwardly to a carry position where the center of gravity of the load is over the front axle or between the front and rear axles of the vehicle. During the lifting mode, an outrigger is utilized until the center of gravity is shifted rearwardly over the front axle. The dual four-bar linkage that forms the lifting mechanism is hydraulically supported and operated, and with the aid of the outrigger and load rest mechanism, the vehicle can carry loads greatly in excess of its weight.

DESCRIPTION OF THE PREFERRED EMBODIMENT OF THE INVENTION

Figure 1:
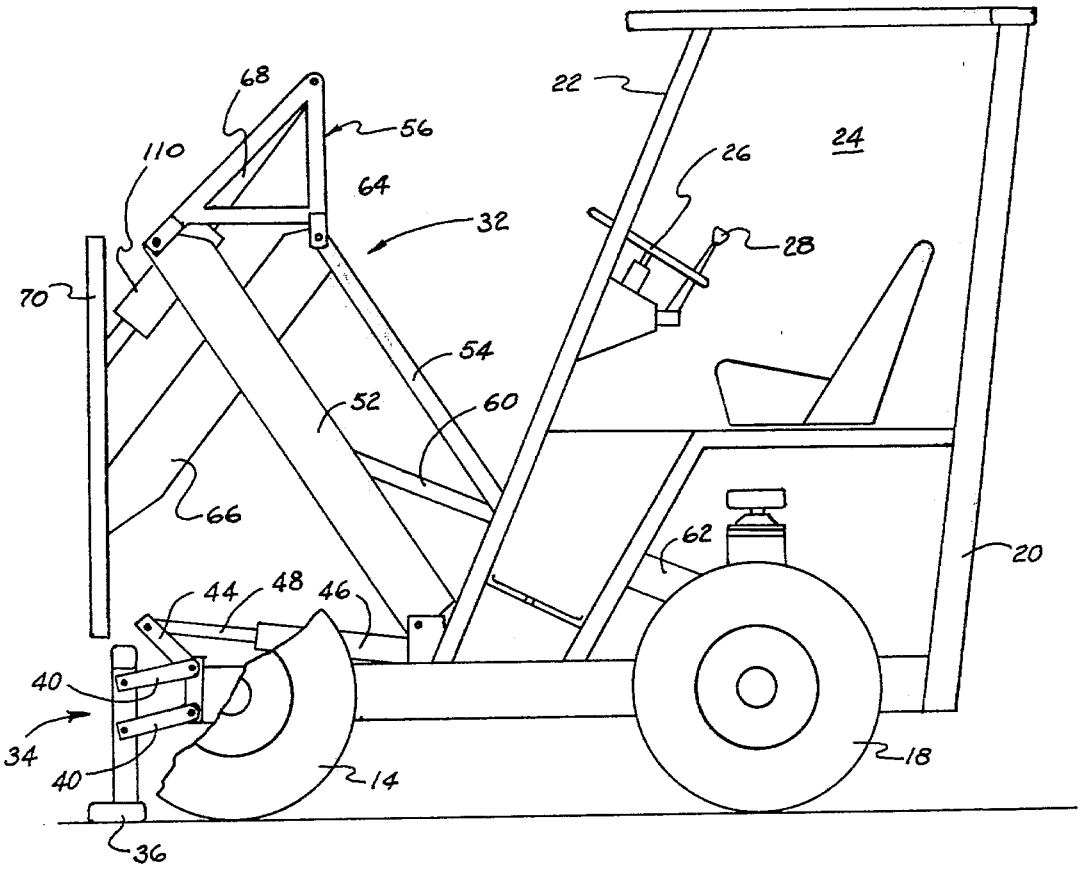
FIG. 1 is a side elevational view of a material handling vehicle constructed according to the principles of my invention, with portions of the lifting linkage and the front wheel broken away.

The material handling vehicle of the invention has a main vehicle frame indicated generally by the reference numeral 10 that supports a front axle 12 carrying wheels 14. The rear of the frame 10 is supported from a steerable rear axle assembly, indicated generally by the reference numeral 16, which assembly contains turnable rear wheels 18. The connection between frame 10 and rear axle assembly 16 is a rocker pin 104 which allows front and rear wheels to make firm ground contact in rolling terrains. Affixed to the rear of the main frame 10 are vertical frame members 20, and on the left side of the vehicle (FIG. 1) cab frame members 22 define an operator's station 24 in which are located a steering wheel 26 and control levers 28.

Figure 2:
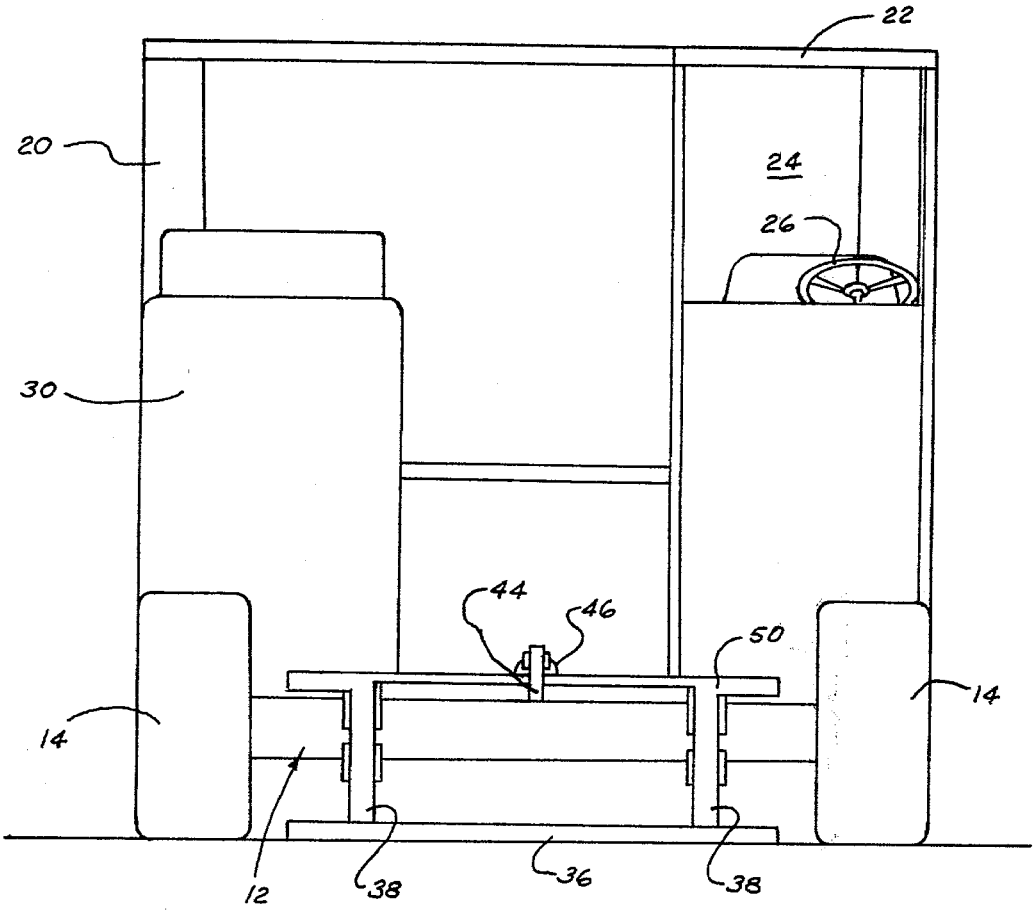
FIG. 2 is a front elevational view of the vehicle with the lifting linkage not shown.

On the right side of the machine (FIG. 2) a housing 30 encloses a power unit (not shown) of any suitable type either gasoline or diesel powered. The power unit supplies the necessary power for the hydraulic system (not shown) which operates and controls the lifting assembly, indicated generally by the reference numeral 32, and the outrigger assembly indicated generally by the reference numeral 34. The power unit also drives pumps (not shown) which supply hydraulic power to hydraulic motors (not shown) contained inside of short axles 84. The hydraulic motors power the wheels 14 and 18.

The outrigger assembly 34 includes a foot pad 36 engagable with the ground upon which the vehicle is resting which foot pad 36 is affixed to a pair of vertical supports 38. The outrigger assembly 34 is raised and lowered by means of a parallelogram or four-bar linkage arrangement connected to each of the two vertical uprights 38. The four-bar linkage arrangement includes a pair of parallel horizontal links 40 each pivotally connected at one end to a vertical support 38. The other ends of horizontal links 40 are pivotally connected in a suitable manner to a portion of the main frame 10. Each of the upper ones of horizontal links 40 are joined at their rear ends by a cross bar 42 that has affixed to it a lifting arm 44 that extends upwardly and forwardly from the cross bar 42. A hydraulic cylinder 46 is pivotally mounted at a suitable place to a portion of the main frame 10 and has its operating rod 48 pivotally connected to the lifting arm 44. Thus, when the hydraulic cylinder 46 is actuated and the operating rod 48 extended, the foot pad 36 will be lowered to the ground and held in that position by reason of the force of the hydraulic cylinder 46.

Because of the four-bar linkage arrangement, the vertical supports 38 will always be raised and lowered substantially perpendicularly to the main frame 10. With a load rest bar 50 extending horizontally across the top of the vertical supports 38, and through actuation of the lifting assembly 32 as described more fully hereinafter, the load can be supported on the bar 50 while the load is being carried thus providing further stability for the vehicle.

Figure 4:
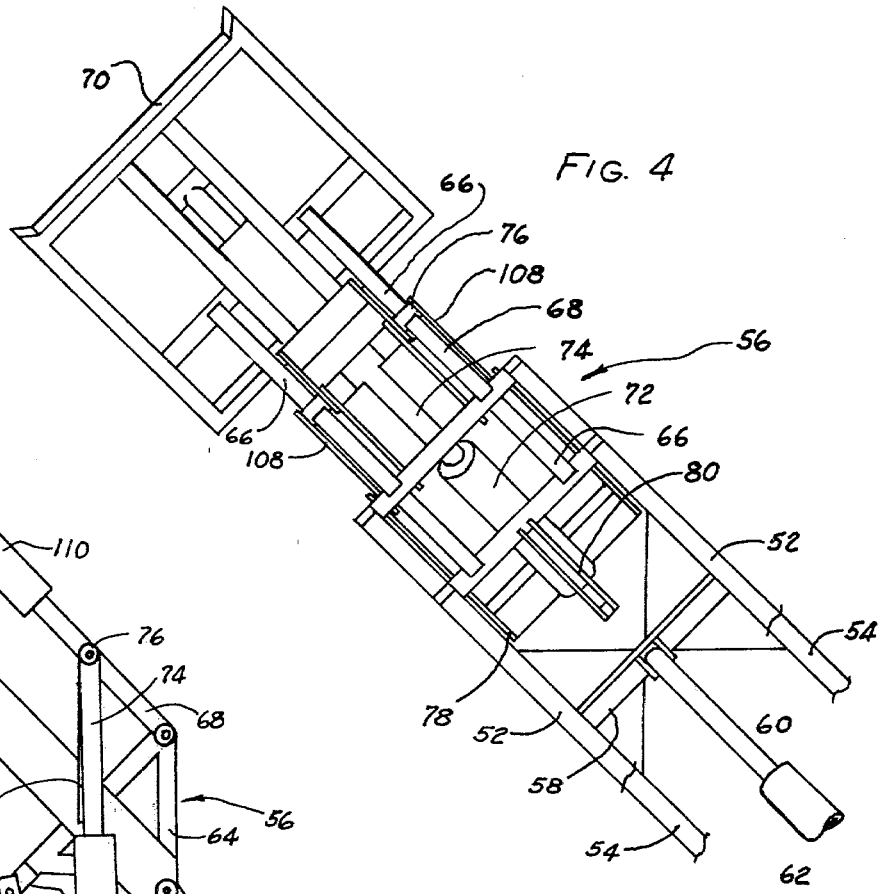
FIG. 4 is a top or plan view of the linkage of FIG. 3.
Figure 3:
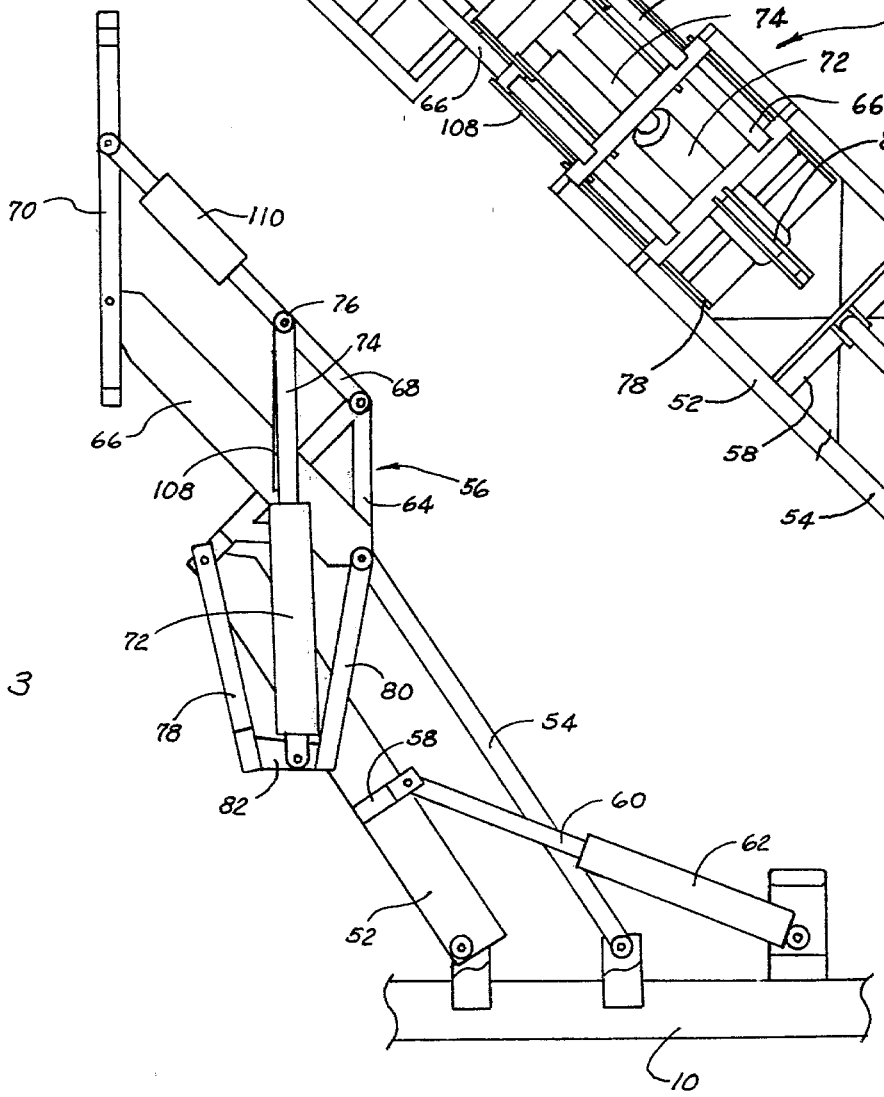
FIG. 3 is an enlarged side elevational view, partly in section, of the lifting linkage showing the linkage in its upper most position.

Referring now to FIGS. 3 and 4, the lifting assembly 32 will be described. FIG. 3 is a side elevational view of the lifting linkage with the left portion of the linkage removed for purposes of clarity. A first four-bar linkage is provided by a main advance arm 52 pivotally connected to the main frame 10 and a secondary advance arm 54 parallel to arm 52. Both arms 52 and 54 are pivotally connected at one end to the main frame 10 and are pivotally connected at their other end to one leg of a triangular shaped upper linkage frame 56.

As shown in FIG. 4, a second pair of main and secondary advance arms 52 and 54 corresponding to the first pair of arms 52 and 54 are also pivotally connected at one end to the main frame 10 and at their upper ends to the upper linkage frame 56. Arms 52 are joined by a cross member 58 which is pivotally connected to the free hand of an operating rod 60 of a hydraulic cylinder 62. Hydraulic cylinder 62 is pivotally connected also to the main frame 10 and provides the power for operating the advance mechanism.

A second four-bar linkage is provided by the vertical leg 64 of the upper linkage frame 56 which has pivotally connected at its ends the main lifting arm 66 and the secondary lifting arm 68. Arms 66 and 68 are parallel to each other and parallel to corresponding arms 66 and 68 connected at the right side of the upper linkage frame 56 (FIG. 4). At the outer ends of the arms 66 and 68, there is pivotally connected a rectangular shaped load frame 70 which will generally be provided with an appropriate accessory such as lifting forks, a bucket, etc. (not shown).

The upper linkage frame 56 also supports a hydraulic lift cylinder 72 which has the free end of its operating rod 74 connected to a cross member 76 joining the lifting arms 68. The hydraulic cylinder is pivotally connected to a supporting frame consisting of a pair of rotating links 78 and 80 joined by a connecting member 82 which provides the pivotal mounting for the end of the hydraulic cylinder 72.

The load frame 70 may also be tilted by the hydraulic cylinder 110 which is pivotally connected to the cross-member 76 and the load frame 70. Two tension hangar members 108 are also connected at cross-member 76 and extend downward to a pivotal connection with the main lifting arms 66. Thus, actuation of the hydraulic cylinder 72 supports and activates cross-member 76 which in turn lifts the main lifting arms 66 through the tension hangar members 108, and thus the load frame 70 is supported at the outer ends of arms 66 with the tilt cylinder 110 being the stabilizer and vertical control.

With the arrangement thus described, it will be evident that the lifting assembly 32 includes two four-bar linkages interconnected by linkage frame 56. This triangular shaped linkage frame 56 will "float" with the two four-bar linkage arrangements and will always have the vertical legs 64 in a substantially vertical position. The upper linkage frame 56, in providing support for the hydraulic cylinder 72, transmits the forces from the upper linkage arrangement to the lower linkage arrangement and then to the main frame 10.

With the foregoing described lifting assembly, the hydraulic cylinder 62, by operating the lower four-bar linkage, provides the capability of extending the load frame 70 forwardly and rearwardly and also provides some of the lifting function. The upper linkage arrangement that is powered by the hydraulic cylinder 72 provides the main lifting force for the load frame 70. The entire lifting assembly 32 thus permits the load frame 70 to be lowered and extended forwardly to pick up a load in almost any position, including a load resting on the ground. With the assistance of the outrigger assembly 34, the load can then be lifted sufficiently to clear the front wheels 14 and then moved rearwardly to shift the center of gravity of the load over or rearwardly of the front axle 12. Once the center of gravity is thus shifted rearwardly, lifting of the load can continue using primarily the upper linkage frame operated and powered by the hydraulic cylinder 72. If desired, the outrigger assembly 34 can be also lifted and the load rested upon the bar 50 while it is being carried. The double four-bar arrangement of the lifting assembly 32 thus provides a very flexible lifting arrangement that adds versatility to the vehicle and permits the vehicle to lift and carry loads greatly in excess of the weight of the vehicle.

Figure 6:
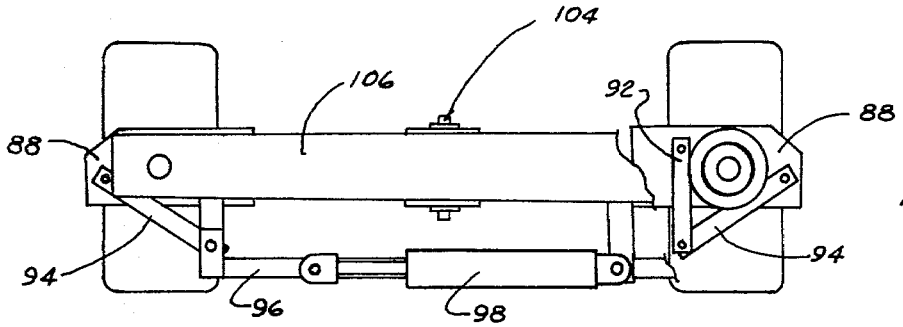
FIG. 6 is a top or plan view of the rear axle assembly of FIG. 5.
Figure 5:
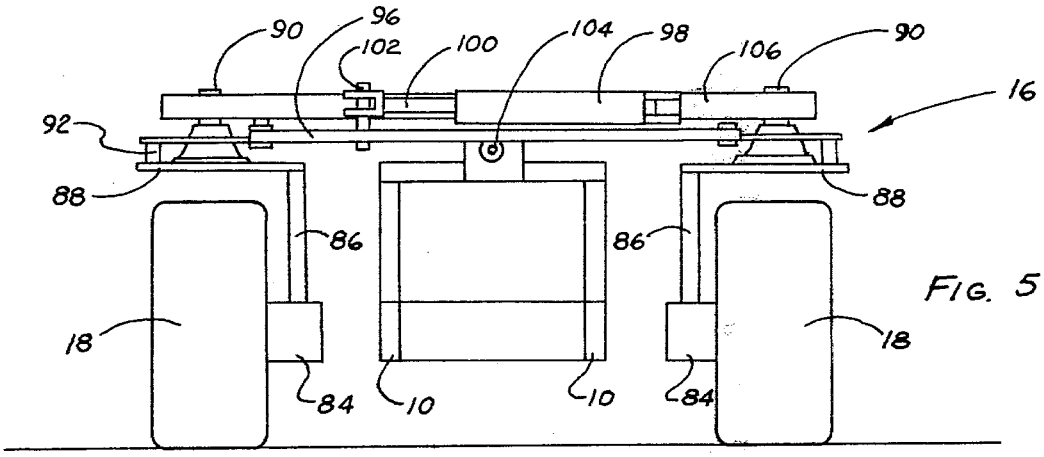
FIG. 5 is a rear elevational view of the rear axle assembly of the vehicle illustrating the steering mechanism.

Referring now to FIGS. 5 and 6, there is shown a steering mechanism for the vehicle which, through a very simple arrangement, provides for excellent maneuverability of the vehicle. The rear wheels 18 are each supported on short axles 84 each of which is in turn connected to a vertical arm 86. The upper ends of vertical arms 86 are affixed to plate 88 which is one leg of a triangular control linkage. Plate 88 is turnable about pivot 90 connected to a rocker arm 106. The second leg 94 of the triangular control linkage is pivotally connected at one end to plate 88 and at the other end to the angular leg 92 which in turn is pivotally connected at one end to tie rod 96 and at the other end to rocker arm 106. The hydraulic cylinder 98 is pivotally connected to the rocker arm 106 and has its operating rod 100 pivotally connected to pin 102 which in turn is affixed to the tie rod 96. Thus, when hydraulic cylinder 98 is actuated, tie rod 96 will be shifted to the right or left which in turn rotates the control linkage to the right or left causing plates 88 to pivot about pivot points 90 thus turning the wheels 18. With this arrangement, it is obvious that a very simple but quite effective hydraulic steering system is provided that is easily actuated by a single control from the operator's station 24.

Having thus described a preferred embodiment of the invention, it will be obvious to those skilled in the art that various revisions and modifications can be made to the preferred embodiment without departing from the spirit and scope of the invention. It is my intention however that all such revisions and modifications as are obvious to those skilled in the art will be included within the scope of the following claims.

I claim:

1. A material handling vehicle for moving a load a short distance, said vehicle comprising a main vehicle frame, front and rear ground-engaging wheels supported by said frame on a fixed wheel base, means for powering said vehicle, a first lifting assembly pivotally supported by said frame, said first lifting assembly including a four-bar linkage arrangement, a linkage frame pivotally connected to the outer end of said first lifting assembly, a second lifting assembly pivotally supported by said linkage frame, said second lifting assembly including a four-bar linkage arrangement, attachment means at the outer end of said second lifting assembly to provide for lifting and carrying a load at one end of the vehicle, first control means for controlling movement of said first lifting assembly, second control means for controlling movement of said second lifting assembly, said first and second lifting assemblies providing for the positioning of a load with its center of gravity between the front and rear wheels, and outrigger means moveable to and from a ground-engaging position to assist in supporting a load during the lifting of the load and positioning of the load to a carrying position.

2. The material handling vehicle of claim 1 in which the attachment means is pivotally connected at the outer end of said second lifting assembly, and there is provided third control means for controlling movement of said attachment means.

3. The material handling vehicle of claim 2 in which said first, second and third control means are hydraulically actuated cylinders, and each of said three control means is operable independently of the others.

4. The material handling vehicle of claims 1, 2 or 3 in which said outrigger means includes a four-bar linkage arrangement with a ground engaging pad at the lower outer end of said linkage arrangement, and said outrigger means is controlled and operated by a hydraulic cylinder.

5. The material handling vehicle of claim 4 in which said outrigger means includes a load rest bar affixed to the outer end of said four-bar linkage arrangement, said load rest bar being engageable with said attachment means when the load is in a carrying position and the outrigger means is disengaged from the ground.

6. The material handling vehicle of claims 1, 2 or 3 in which the first and second lifting assemblies extend forwardly over the front wheels of the vehicle, and the rear wheels are turnable in order to steer the vehicle.

7. The material handling vehicle of claim 6 in which each of the rear wheels is mounted on a separate axle and is driven by a hydraulic motor, a rocker arm is connected to the main vehicle frame, and each of the axles is turnably connected to said rocker arm, a tie rod and means interconnecting said tie rod to said axles is provided, and a hydraulic cylinder controls movement of said tie rod to steer said vehicle.

* * * * *